US010315454B2

(12) United States Patent
Sailer et al.

(10) Patent No.: US 10,315,454 B2
(45) Date of Patent: Jun. 11, 2019

(54) METHOD FOR PROCESSING A SECURITY ELEMENT

(71) Applicants: Gemalto AG, Aarau (CH); Orell Füssli Sicherheitsdruck AG, Zurich (CH)

(72) Inventors: Christian Sailer, Safenwil (CH); Sylvain Chosson, Zurich (CH); Felix Abt, Zurich (CH)

(73) Assignees: Orell Füssli Sicherheitsdruck AG, Zurich (CH); Gemalto AG, Aarau (CH)

( * ) Notice: Subject to any disclaimer, the term of this patent is extended or adjusted under 35 U.S.C. 154(b) by 0 days.

(21) Appl. No.: 15/315,929

(22) PCT Filed: Nov. 24, 2015

(86) PCT No.: PCT/EP2015/077503
§ 371 (c)(1),
(2) Date: Dec. 2, 2016

(87) PCT Pub. No.: WO2016/192818
PCT Pub. Date: Dec. 8, 2016

(65) Prior Publication Data

US 2017/0182832 A1 Jun. 29, 2017

(30) Foreign Application Priority Data

Jun. 5, 2015 (WO) ..... PCT/EP2015/062577

(51) Int. Cl.
*B42D 25/41* (2014.01)
*B42D 25/435* (2014.01)
(Continued)

(52) U.S. Cl.
CPC ..... *B42D 25/41* (2014.10); *B42D 25/24* (2014.10); *B42D 25/351* (2014.10); *B42D 25/435* (2014.10)

(58) Field of Classification Search
CPC .... B42D 25/41; B42D 25/435; B42D 25/351; B42D 25/24
(Continued)

(56) References Cited

U.S. PATENT DOCUMENTS 6,505,779 B1 * 1/2003 Power ..... B42D 25/41 235/487
8,336,915 B2 12/2012 Christen et al.
(Continued)

FOREIGN PATENT DOCUMENTS

CN 101468567 A 7/2009
FR 2918311 A1 1/2009
(Continued)

*Primary Examiner* — Justin V Lewis
(74) *Attorney, Agent, or Firm* — The Webb Law Firm

(57) ABSTRACT

A method for producing an authenticity information item of a security element, which serves for checking the correct combination of carrier parts. The security element comprises at least one first partial element having a first partial information item and a second partial element having a second partial information item. The two partial elements are movable into a check position, in which the two partial elements overlay one another. The information items in the check position represent the information item. In an alignment step, the two partial elements are provided with at least one processing means, with which waves the first partial information item and the second partial information item are produced. One of the two partial elements is processed with the waves directly, and the other of the two partial elements is processed through the one partial element.

20 Claims, 8 Drawing Sheets

(51) Int. Cl.
*B42D 25/351* (2014.01)
*B42D 25/24* (2014.01)

(58) Field of Classification Search
USPC ..... 283/67, 70, 72, 74, 94, 98, 901
See application file for complete search history.

(56) References Cited

U.S. PATENT DOCUMENTS

| | | | | |
|---|---|---|---|---|
| 2004/0245765 | A1* | 12/2004 | Taylor | B41M 3/14 283/81 |
| 2008/0088859 | A1* | 4/2008 | Depta | B42D 25/41 358/1.7 |

FOREIGN PATENT DOCUMENTS

| | | | |
|---|---|---|---|
| WO | 9815418 | A1 | 4/1998 |
| WO | 9936271 | A1 | 7/1999 |
| WO | 2005108106 | A1 | 11/2005 |
| WO | 2006079224 | A1 | 8/2006 |

* cited by examiner

METHOD FOR PROCESSING A SECURITY ELEMENT

CROSS-REFERENCE TO RELATED APPLICATIONS

This application is the United States national phase of International Application No. PCT/EP2015/077503 filed Nov. 24, 2015, and claims priority to International Application No. PCT/EP2015/062577 filed Jun. 5, 2015, the disclosures of which are hereby incorporated in their entirety by reference.

BACKGROUND OF THE INVENTION

Field of the Invention

The present invention relates to a method for producing a security element.

Description of Related Art

Identity documents, in particular passports, typically comprise a cover, a plurality of visa pages, and a data page. The visa pages and the data page are combined with the cover to make up a passport and form one unit.

The data page of a passport contains personalized information pertaining to the owner, such as a photograph, name, date of birth etc. WO 2006/079224 discloses one example of such a data page.

In some passport forgeries, the data page is removed from a passport and inserted into another passport. As a result, the visa pages and the cover no longer match the data page.

SUMMARY OF THE INVENTION

It is an object of the present invention to provide a method for producing a security element with an authenticity information item for checking the correct combination of at least two, or exactly two, carrier parts, wherein the security element comprises at least one first partial element having a first partial information item and a second partial element having a second partial information item, wherein the first partial element is assignable to a first carrier part and the second partial element is assignable to a second carrier part, and wherein both partial elements are movable from a starting position into a check position, in which one partial element overlays the other, wherein the first partial information item and the second partial information item in the check position represent said authenticity information item.

The object is achieved by way of a method that serves for producing an authenticity information item of a security element for checking the correct combination of at least two, or exactly two, carrier parts, wherein the security element comprises at least one first partial element having a first partial information item and a second partial element having a second partial information item, wherein the first partial element is assignable to a first carrier part, and the second partial element is assignable to a second carrier part, and wherein both partial elements are movable from a starting position into a check position, in which one partial element overlays the other, wherein the first partial information item and the second partial information item in the check position represent said authenticity information item. In an alignment step, the two partial elements are positioned on top of one another and are aligned relative to one another; in a fixing step, the two partial elements are fixed in their aligned positions relative to one another, and in a processing step, electromagnetic waves are provided by at least one processing means with which waves the first partial information item and the second partial information item are produced, wherein one of the two partial elements is processed directly with said waves, and the other of the two partial elements is processed through said one partial element.

It is thus possible in a simple manner to produce the first and the second partial information item with the method according to the invention.

Said one of the partial elements is here located on top of the other partial element. The partial element which is located closer to the processing means can be processed directly with the processing means, and the partial element which is located further away from the processing means is processed indirectly, because the processing means must penetrate the partial element which is located closer to the processing means.

Both partial elements are preferably processed exclusively and immediately by the processing means. Exclusively and immediately mean that only the processing means is used for processing the two partial elements and that these two partial elements do not undergo any other processing for the personalization. One example of other processing is the removal of said one partial element and using what was removed for processing the other partial element. Consequently, the processing is preferably effected only with the processing means.

At least before the processing, the partial element which is located closer to the processing means is preferably transmissive or transparent for the electromagnetic waves of the processing means. After processing, the partial element which is located closer to the processing means is typically blackened or otherwise changed, as a result of which said transmissivity or transparency is or could be impaired. As a consequence, the electromagnetic waves can penetrate the partial element which is located closer to the processing means to reach the partial element which is located further away from the processing means. In other words, the electromagnetic waves penetrate the partial element which is located between the processing means and the partial element that is located further away with respect to the processing.

The processing means is preferably a laser, in particular a solid-state laser having a wavelength which can extend from the UV range into the infrared range, wherein in particular a wavelength from the near infrared range of 1000 to 1200 nm is preferred.

At least one processing parameter of said electromagnetic waves is preferably changed such that selectively either the first partial element or the second partial element can be processed. Consequently, preferably either the first partial information item is produced in the first partial element, or the second partial information item is produced in the second partial element. By changing the processing parameter, preferably exclusively one of the two partial information items is produced, or in other words, preferably either said one partial information item or said other partial information item is produced. With particular preference, there is no simultaneous or concurrent production of the two partial information items.

In other words, in the processing step, at least one processing means is preferably used to provide electromagnetic waves with which waves the first partial information item and the second partial information item are produced, wherein said waves are used to process one of the two partial elements directly and to process the other of the two partial elements through said one partial element, with selectively either the first partial element or the second partial element being processed.

The processing of the first partial element takes place preferably at a different time than the processing of the second partial element. Exclusively the first partial information item of the first partial element is provided over a first time window, and exclusively the second partial information item is provided over a second time window. The first time window differs from the second time window.

The first partial information item is particularly preferably different from the second partial information item. The partial information items are preferably configured, as indicated below, such that the authenticity information item is formed by way of overlaying the two partial information items in the check position. It is therefore with particular preference not absolutely necessary for the two partial information items to be produced simultaneously.

The first partial information item thus differs from the second partial information item in terms of its form or in terms of its position. The partial information items preferably differ from one another. In other words, the first partial information item is not identical to the second partial information item, or the first partial information item is not exactly the same as the second partial information item.

At least one processing parameter of said electromagnetic waves is preferably changed such that the first partial element and/or the second partial element can be processed. By changing the at least one processing parameter, either the first and/or the second partial element can be correspondingly targeted or can be processed.

The processing parameter which is changed is preferably the intensity of the electromagnetic waves. In other words, the intensity of the waves provided by the processing means is changed, as a result of which each of the partial elements can be targeted individually.

Alternatively, the processing parameter which is changed is the focal position, wherein the focal position of the waves provided by the processing means is changed, as a result of which each of the partial elements can be targeted individually.

Alternatively, the processing parameter which is changed is the wavelength, wherein the wavelength of the waves provided by the processing means is changed, as a result of which each of the partial elements can be targeted individually.

Alternatively, the processing parameter which is changed is the pulse energy and/or the laser power, wherein the pulse energy and/or laser power of the waves provided by the processing means is changed, as a result of which each of the partial elements can be targeted.

A combination of at least two of the individual processing parameters to be changed is also conceivable. For example, the following changes of the processing parameters are conceivable:

intensity and focal position or
intensity and wavelength or
focal position and wavelength or
intensity, focal position and wavelength.

The above combinations of changing processing parameters are also possible with a variant of the changing pulse energy and/or laser power.

Alternatively, the processing parameter which is changed is the intensity of the electromagnetic waves and the focal position, wherein the intensity and the focal position of the waves provided by the processing means are changed, as a result of which each of the partial elements can be targeted.

With particular preference, at least one processing parameter is changed such that any position between the upper side of the first partial element and the bottom side of the second partial element is processable. Hereby, any depth between said upper side and said bottom side can be addressed. Depending on the thickness of the partial elements, it is thus possible to create a partial information item having a three-dimensional effect.

With particular preference, the production of said partial information items takes place in a single fixation, wherein both the first partial element and the second partial element are processed in said fixation.

With respect to the processing of the partial information item over an expansion range parallel to the surface of the respective partial element, two variants are particularly preferred. In a first variant, the expansion range of the partial information item is systematically traversed by the processing means parallel to the surface of the respective partial element, wherein said at least one processing parameter is changed during the traversing operation such that the corresponding positions are addressed. In a second variant, the expansion range of the partial information item is systematically traversed by the processing means in at least two passes, wherein said at least one processing parameter is changed for each of the passes and in particular during the passing.

With particular preference, exactly one processing means is present, for which the processing parameters can be set. It is possible with this single processing means to produce both the first and the second partial information item. To this end, at least one processing parameter of the single processing means is set, in particular according to the above-described variants.

Alternatively, at least a first processing means and at least a second processing means are present, which provide electromagnetic waves having different processing parameters. To this end, the processing parameter of these processing means is set, in particular according to the above-described variants.

In the embodiment having the at least two processing means, two variants are particularly preferred with respect to the processing of the partial information item over an expansion range parallel to the surface of the respective partial element.

In a first variant, the expansion range of the partial information item is systematically traversed by the processing means in one pass parallel to the surface of the respective partial element. The processing parameters can change for a traversing operation.

In a second variant, the expansion range of the partial information item is systematically traversed by the processing means in at least two passes parallel to the surface of the respective partial element, wherein one of the processing means is active during the one pass with a fixed or varying processing parameter, and wherein the other one of the processing means is deactivated during said pass. In the active processing means, the processing parameter can be fixed or variable during a pass.

With particular preference, the two partial elements in all of the above-described embodiments of the method are in direct surface contact with one another during the processing step. The two partial elements thus rest firmly against one another, without anything else being arranged between the two partial elements.

Alternatively, a separating film is inserted between the two partial elements before or during the alignment step. The separating film prevents any particles which have been dislodged by the processing means from being transferred from one partial element to the other partial element.

The separating film is preferably provided with an adhesive layer on the side facing the first partial element and/or on the side facing the second partial element.

The separating film preferably serves as a carrier for an ink, which is detached from the separating film through processing with the processing means and is transferred to the first and/or the second partial element, to which it then adheres.

In all the above-described variants or embodiments, it is particularly advantageous if no interaction, in particular no transfer of particles, takes place between the first partial element and the second partial element during the processing with the processing means. In particular, neither of the two partial elements serves for the processing of the other partial element. This means, for example, that no particles or the like are transferred from the first partial element to the second partial element and cause material removal or material deposition there.

The response behavior of the first partial element with respect to a defined set of processing parameters is preferably different from the response behavior of the second partial element with respect to the same set of processing parameters. This is what allows the processing of the individual partial elements.

The first partial element is preferably made of plastics, and the second partial element is a paper substrate, wherein both the plastics and the paper substrate are variable by the processing means in an optically perceivable manner.

Alternatively, an ink layer and/or a stamping foil layer is/are applied to the paper substrate, which layer is/are changed in an optically perceivable manner.

The processing with the processing means results in a color change and/or a material removal on the first partial element or the second partial element.

A security element with an authenticity information item for checking the correct combination or assignment of at least two, or exactly two, carrier parts comprises at least one first partial element having a first partial information item and a second partial element having a second partial information item. The first partial element is assignable to a first carrier part, and the second partial element is assignable to a second carrier part. Both partial elements are movable from a starting position into a check position, in which one partial element overlays the other, wherein the first partial information item and the second partial information item in the check position represent said authenticity information item.

The partial information items are preferably produced by way of the above-described method.

In the check position, the authenticity information item is formed by the first partial information item and the second partial information item. It is hereby possible to check in a simple manner whether the assignment of the first carrier part to the second carrier part is correct. If one of the two partial information items is not compatible with the other partial information item, the information item that is represented is one from which it is perceivable that the information item is not said authenticity information item. This signals to the person checking the correct assignment of the two carrier parts that the two carrier parts do not belong together, which indicates a manipulation.

In a further variant, the security element comprises, in addition to the first partial element and the second partial element, a third partial element having a third partial information item. The third partial element is assignable to a third carrier part and is movable with respect to the first partial element from a starting position into a check position in which the two partial elements, that is to say the first partial element and the third partial element, overlay one another, wherein the first partial information item and the third partial information item in the check position represent a further authenticity information item.

The third partial information item can be produced according to the above-described method analogously to the first and to the second partial information item.

The further authenticity information item which is represented by the first partial information item and the third partial information item differs in terms of appearance preferably from the authenticity information item which is represented by the first partial information item and the second partial information item. However, the two authenticity information items can also be configured to be identical or similar with respect to one another.

The first partial information item and the second partial information item preferably complete the authenticity information item in the check position, and/or the first partial information item and the third partial information item complete the further authenticity information item in the check position. Complete means that the partial information items supplement one another and thus form the authenticity information item. By way of example, the first partial information item forms a first part of the authenticity information item and the second partial information item forms a second part of the authenticity information item, with the sum of the two parts producing the authenticity information item.

Generally speaking, the sum of the two partial information items of the corresponding partial elements produces said authenticity information item.

The authenticity information item can, however, also be represented by the supplementation or covering of regions of the partial information item. It is conceivable, for example, for the one partial information item to cover regions of the other partial information item. In addition, said one partial information item can be provided, in the region of the coverage, with an additional partial information item, which then supplements the other partial information item on the other carrier part.

The first partial element or the first partial information item preferably differs from the second partial element or the second partial information item. Furthermore, the third partial element, if present, or the third partial information item, if present, preferably differs from the first or second partial element. As a result, the partial information items can have any desired configuration. Alternatively, the partial information items or the partial elements can also be configured to be identical with respect to one another.

Said carrier parts to which said partial elements having the partial information items are assigned can be part of the security element. This is the case in particular if the partial elements are fixedly connected to the carrier parts or are even integrated in the carrier parts.

In a first variant, the carrier parts are configured separately from one another and are not in connection with one another. The carrier parts to which are in each case assigned a partial element are configured separately from one another. Consequently, the partial elements of the security element are also configured separately from one another. In other words, the security element comprises the first carrier part having the first partial element, the second carrier part having the second partial element, and optionally the third carrier part having the third partial element, with the carrier parts being configured separately from one another.

In a second variant, the carrier parts are configured separately from one another and are in contact with each other via a joint. The joint can be mechanical and/or integral. A mechanical joint can be, for example, a seam of a stitching. An integral joint can be, for example, an adhesive or welding location. In a third variant, the carrier parts are in connection with each other such that they are in one piece.

The authenticity information item is preferably at least one image and/or at least one alphanumeric character, wherein the first partial information item represents a first part of the at least one image or of the at least one alphanumeric character, and wherein the second partial information item represents a second part of the at least one image or of the at least one alphanumeric character.

The authenticity information item is preferably a graphically representable information item.

The image as the authenticity information item can be, for example, a photograph, a portrait of the owner of an identification document, the outline of a country, a national coat of arms, a national flag, or a graphical information item. The alphanumeric authenticity information item can be, for example, a document number, a registration number, or a code.

The partial information item is preferably provided such that it can be optically differentiated from directly adjacent regions which are part of the partial element. The partial information item is thus optically identifiable by a viewer. The partial information item is preferably provided in the form of an opaque and/or semi-opaque region. This region is then clearly identifiable by the user and forms at least one part of the partial information item.

At least one of the partial elements preferably comprises at least one transparent or translucent region and at least one opaque and/or semi-opaque region. In the case of an overlay, the partial information item of another partial element becomes visible through the transparent or translucent region, wherein said authenticity information item is completed thereby. Consequently, the one partial information item of one partial element becomes visible through the transparent or translucent region of the other partial information item.

With particular preference, the transparent or translucent region is provided in the form of a window in the corresponding carrier part, wherein opaque and/or semi-opaque regions representing the one partial information item are provided in the region of the window. The other partial information item is then visible through the transparent or translucent regions through the window, and in this manner the authenticity information item is assembled. Said regions representing the partial information item can preferably be provided by way of one, in particular the same, or by way of a plurality of processing means.

The opaque region preferably serves for supplementing the other partial information item, wherein the opaque region provides the partial information item as such, and/or wherein the opaque region is additionally provided within its region with further partial information items, which likewise supplement the other partial information item.

The partial information item in the window can appear as positive or as negative, depending on the viewing direction. Positive and negative could be real positives and negatives, meaning that they are identical to one another as positive and negative. Alternatively, positive and negative can also be non-real positives or negatives, meaning that they are unequal with respect to one another as positive and negative, for example by way of an arrangement of further partial information items in an opaque region.

The first partial information item is present particularly preferably in the form of at least one opaque and/or semi-opaque region in a transparent or translucent window, while the second and, if appropriate, the third partial information item are present in the form of at least one opaque region, which then becomes visible through the transparent or translucent window of the first partial information item. The partial information item can be assembled from multiple regions or merely from one region.

Said processing means is preferably a printer, wherein said at least one region is printed. Alternatively, the processing means can also be a laser, wherein said at least one region can be provided by a laser-activatable additive, which is variable in terms of color by way of processing being carried out with a laser, or wherein said at least one region can be provided by a metal foil or plastics pigments which are locally destroyable by way of processing being carried out with a laser. The latter is also referred to as metal ablation or plastics ablation. However, said regions can also be used by using said processing means in combination with one another.

Said laser-activatable additive is preferably present in the material by way of which the window is provided. Said laser-activatable additive advantageously has the form of plastics pigments present in the window. Said metal foil or the plastics segments for the ablation are preferably likewise part of the window and can extend over the entire window area or over only part thereof.

The authenticity information item is preferably a personalized information item, in particular a portrait or an alphanumerically presentable personalized information item. The authenticity information item can, however, also be an individualized information item, in particular a document number.

The authenticity information item is preferably distributed over the partial elements according to a random scheme. As a consequence, the partial information items have a random form. Alternatively, the authenticity information item is distributed over the partial elements according to a predetermined scheme or pattern.

The partial elements are preferably defined by area, wherein the area of all partial elements are preferably identical. To the extent that the carrier parts on which the partial elements are arranged are connected to one another, the partial elements are preferably positioned in each case in the same position on the carrier parts.

By way of example, the partial elements are delimited by an external peripheral line, wherein the area delimited by the peripheral line of all partial elements is identical.

In the check position, the partial elements are preferably located one above the other such that they at least partially coincide or entirely coincide.

The first, second and/or third partial information item or the authenticity information item are preferably optically perceivable information items. With particular preference, the partial information items or the authenticity information item are configured such that they are identifiable by the naked eye without using further aids.

Additionally or alternatively, the first, second and/or third partial information item or the authenticity information item can also be configured such that they become identifiable with the use of ultraviolet light or infrared light.

In one variant, the first, second and/or third partial information item can be covered by a security print, which preferably has a greater area than the area of said partial regions.

An identification document, in particular a passport, comprises at least one security element in accordance with the above description and at least a first page corresponding to the first carrier part and a second page corresponding to the second carrier part, wherein the first partial element is fixedly assigned to the first page, and wherein the second partial element is fixedly assigned to the second page, and wherein in the case of an overlay of the two pages, in the check position, the first partial information item and the second partial information item in the overlaid region represent said authenticity information item, in particular complete it.

The first page and the second page are in connection with one another via a joint, such as for example a seam.

In one variant, the identification document has a third page corresponding to the third carrier part, wherein the third partial element is fixedly assigned to the third page, and wherein in the case of an overlay in the check position of the two pages, the first partial information item and the third partial information item in the overlaid region represent said further authenticity information item, in particular complete it. The third page is in connection with the first and the second page via a joint.

The partial elements are preferably integral components of the respective page, so that the partial elements cannot be removed from the respective page.

With particular preference, the first page is a data page and the second page is a visa page or a cover page of a passport. The data page is typically made of plastics, in particular polycarbonate, while the visa page is made from a security paper.

In the embodiment with the first, second and third partial element for providing the two authenticity information items, the third page which corresponds to the third carrier element is a cover page.

Further embodiments are specified in the dependent claims.

BRIEF DESCRIPTION OF THE DRAWINGS

Preferred embodiments of the invention will be described below with reference to the drawings which merely serve for explanation purposes and are not to be interpreted in a limiting fashion. In the drawings.

DESCRIPTION OF THE INVENTION

Figure 1:
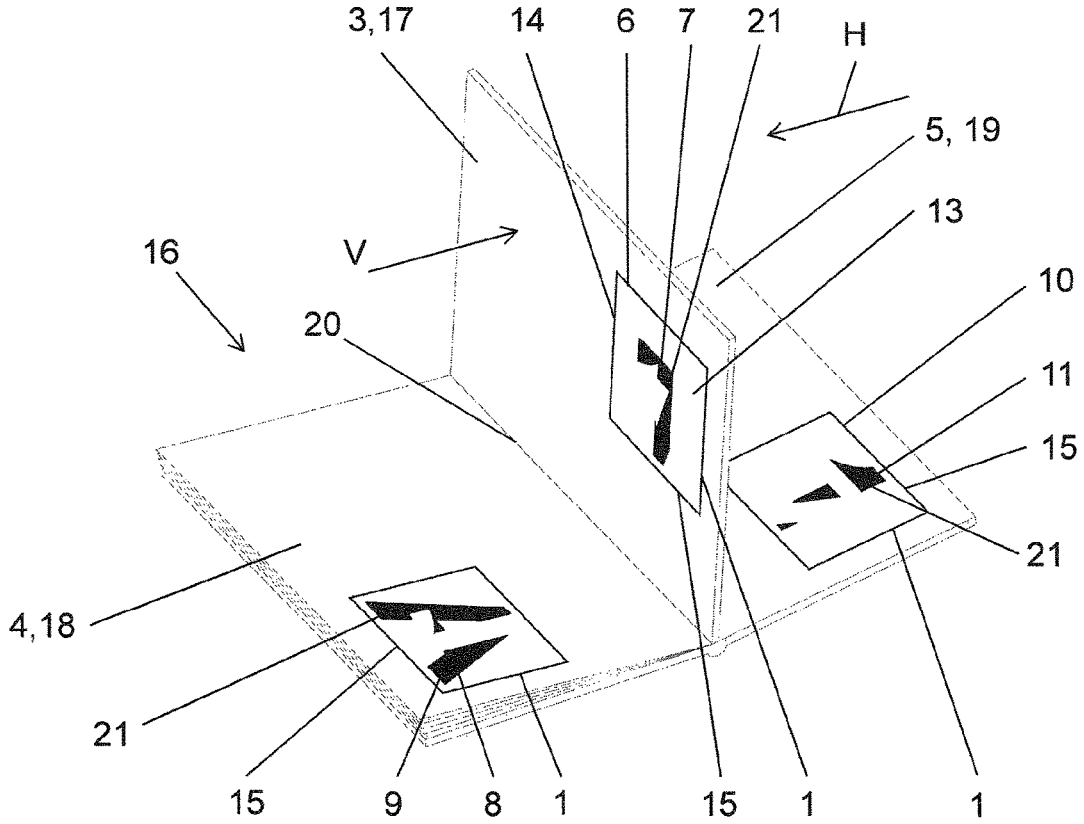
FIG. 1 shows a perspective view of a multi-page document, in particular a passport, having the security element according to the invention.

FIG. 1 shows an identification document 16, in particular a passport, having a security element 1 according to the invention. The identification document 16 will be described below in further detail.

The security element 1 will now be explained in more detail with reference to FIGS. 1 and 2 to 4. The security element 1 comprises an authenticity information item 2 for checking the correct combination or assignment of two, or at least two, in the present case three, carrier parts 3, 4, 5. The authenticity information item signals to the observer whether the carrier parts 3, 4, 5 to be assessed fit together, or whether the carrier parts 3, 4, 5 do not fit together in particular due to non-permissible manipulation, such as a replacement of one of the carrier parts 3, 4, 5.

The security element 1 comprises at least one first partial element 6 having a first partial information item 7 and one second partial element 8 having a second partial information item 9. By way of a relative movement, in particular overlaying, of the first partial element 6 including the first partial information item 7 with respect to/on the second partial element 8 including the second partial information item 8, the authenticity information item 2 is provided.

Figure 3:
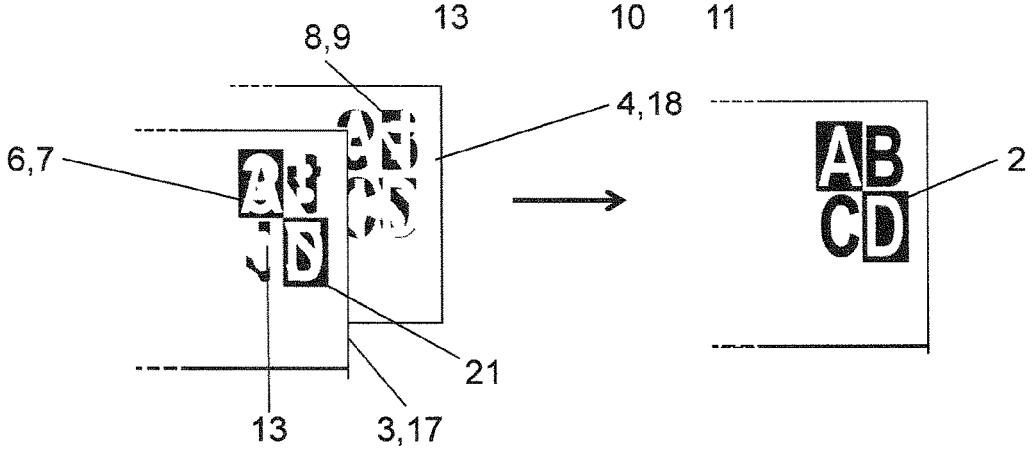
FIG. 3 shows a sequence of the security element according to the invention in the separated and overlaid state.

The first partial element 6 is here assigned to a first carrier part 3, and the second partial element 8 is assigned to a second carrier part 4. The two partial elements 6, 8 are movable relative to one another from a starting position into a check position, wherein starting from the starting position, the two carrier parts 3, 4 are moved toward one another. In FIG. 3, on the left, the carrier parts 3, 4 are shown in the starting position. In FIG. 3 on the right, the carrier parts 3, 4 and consequently also the partial elements 6, 8 are shown in the check position. The partial elements 6, 8 are overlaid in the check position, and the first partial information item 7 and the second partial information item 9 correspondingly represent said authenticity information item 2 in the check position. The authenticity information item in the example of FIG. 3 comprises the letters A, B, C, D, which are arranged within a rectangle. In FIG. 3, it can easily be seen that in the starting position, the partial information items 7, 9 by themselves are not perceivable as an information item which expresses something. It is only by combining the first partial information item 7 with the second partial information item 9 that the authenticity information item 2 becomes visible to the observer. If one of the carrier parts 3, 4 has been replaced by a manipulated carrier part having a different partial information item, the authenticity information item would not be represented, because the two partial information items 7, 9 no longer fit together in the case of a manipulation.

Figure 2:
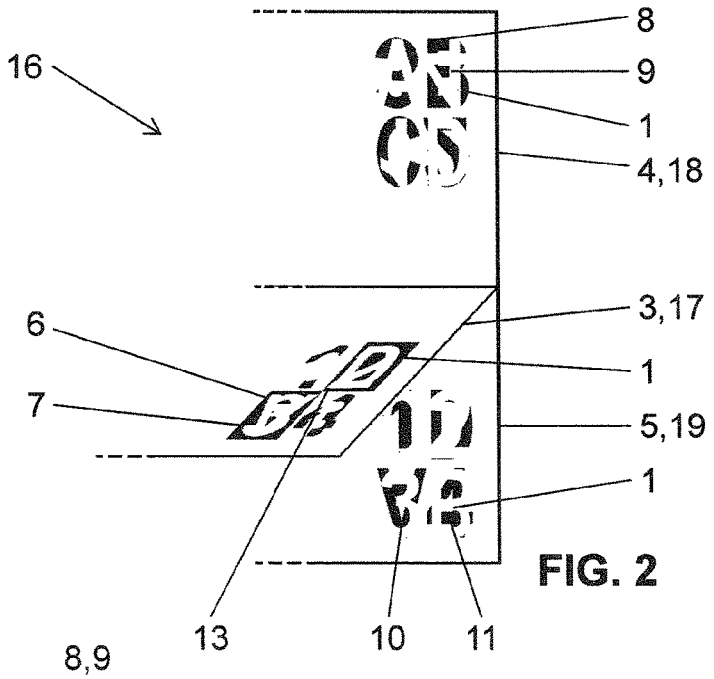
FIG. 2 shows a schematic view of the security element according to the invention on three pages of a multi-page document.
Figure 4:
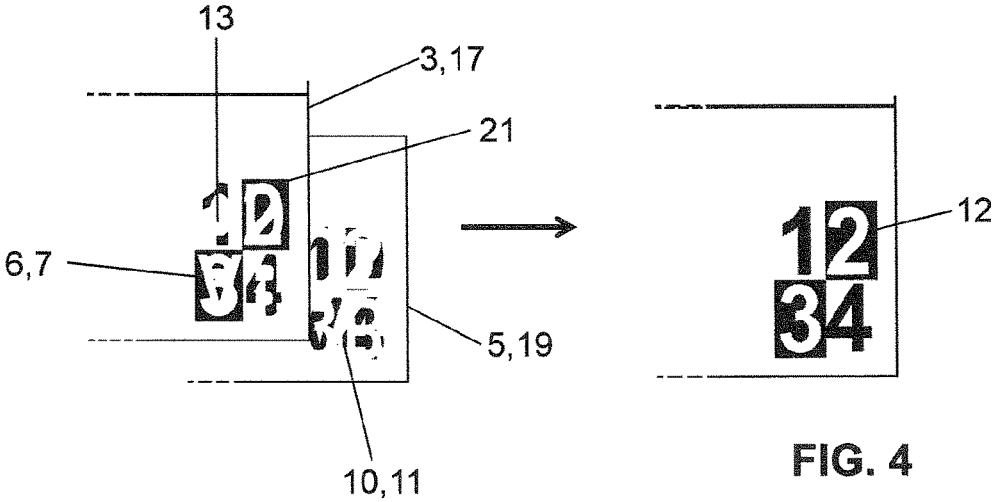
FIG. 4 shows a sequence of the security element according to the invention in the separated and overlaid state.

In the embodiment shown in FIGS. 2 to 4, the security element 1 comprises in addition to the first partial element 6 and to the second partial element 8 a third partial element 10 having a third partial information item 11. The third partial element 10 is assigned to a third carrier part 5. The third partial element 10 having the third partial information item 11 is movable with respect to the first partial element 6 having the first partial information item 7 from a starting position into a check position. In the check position, the first partial element 6 and the third partial element are located one on top of the other and overlay one another, wherein the first partial information item 7 and the third partial information item 11 in the check position represent a further authenticity information item 12. The authenticity information item 12 is correspondingly represented in FIG. 4 and shows the numbers 1, 2, 3, 4.

It can easily be seen with respect to FIGS. 2 to 4 that the first partial information item of the first partial element 6 is identical for the combination with the second partial information item 9 and for the combination with the third partial information item 11. It is thus possible using this one partial information item in combination with the second partial information item 9 and the third partial information item 11 to represent a plurality of, in particular differing from one another, authenticity information items 2, 12.

The representation of the authenticity information item 2, 12 is achieved substantially by completing the respective partial information item 7, 9, 11 with the other partial information item 7, 9, 11. The first partial information item 7 and the second partial information item 9 complete thereby the image such that the authenticity information item 2 is provided, while the first partial information item 7 and the third partial information item 11 complete the image such that the further authenticity information item 12 is represented. This is substantially a sum formation of two information item parts which then leads to the representation of the authenticity information item 2, 12. In other words, the two partial information items to be combined supplement one another in each case to form the authenticity information item.

The carrier parts 3, 4, 5 can be configured in a first variant such that they are separate from one another. Separate in this context is understood to mean that the carrier parts 3, 4, 5 are not physically in connection with each other, but are two parts formed separately from one another. A separate configuration could be used, for example, when adding a package insert to a medicament container. The patient or the medical personnel could then check whether the package insert belongs to the medicament container.

In a second variant, the carrier parts 3, 4, 5 can be configured to be separate from one another, wherein the carrier parts 3, 4, 5 are in connection with each other via a joint. The joint can have various configurations. In a first development according to the second variant, the carrier parts 3, 4, 5 are in contact with one another via a mechanical, preferably non-integral, joint. Such a connection is, for example, a connection as is common in the printing of books, in particular the printing of passports. By way of example, the carrier parts 3, 4, 5 are connected to one another by a stitching using a thread. The carrier parts 3, 4, 5 are indeed configured such that they are separate from one another, but they are in connection with one another via this mechanical connection. In a second development of the second variant, the carrier parts 3, 4, 5 can be in connection with each other via an integral joint, such as an adhesive or welding location. The integral connection can in a development be additionally secured by way of a mechanical connection.

In a third variant, carrier parts 3, 4, 5 can also be in connection with each other such that they form one part. This development has in particular the advantage that increased security against forgeries is provided and manipulation of a one-part document can be easily identified.

In all variants, the invention has the advantage that a check can be performed using the authenticity information item 2, 12 regarding the replacement of one of the carrier parts 3, 4, 5. If one of the carrier parts 3, 4, 5 has been illegally replaced with a different carrier part, a checking person can check this by moving the corresponding carrier parts 3, 4, 5 from the starting position into the check position.

In the embodiment according to FIGS. 2 to 4, the authenticity information item is substantially an alphanumeric character, in the present case a letter and a number. The symbol is here represented as a directly perceivable symbol, see letters B and C and numbers 1 and 4, or indirectly as a symbol which is arranged in a frame, see letters A and D and numbers 2 and 3.

Figure 5:
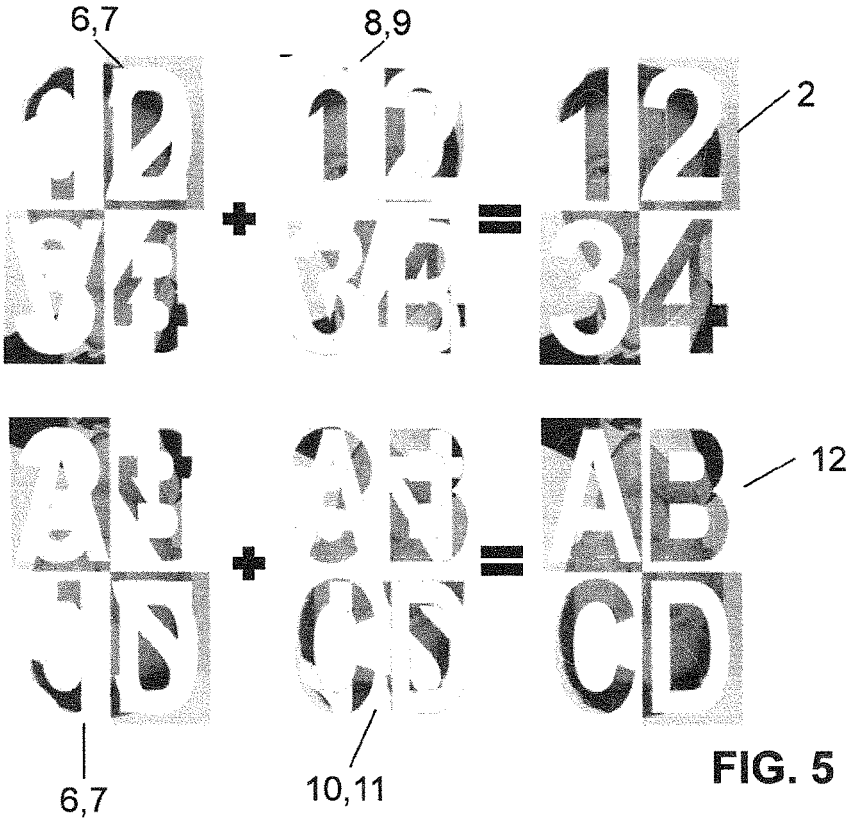
FIG. 5 shows a further embodiment of the security element according to the invention in accordance with the present invention in the separated and overlaid state.
Figure 6:
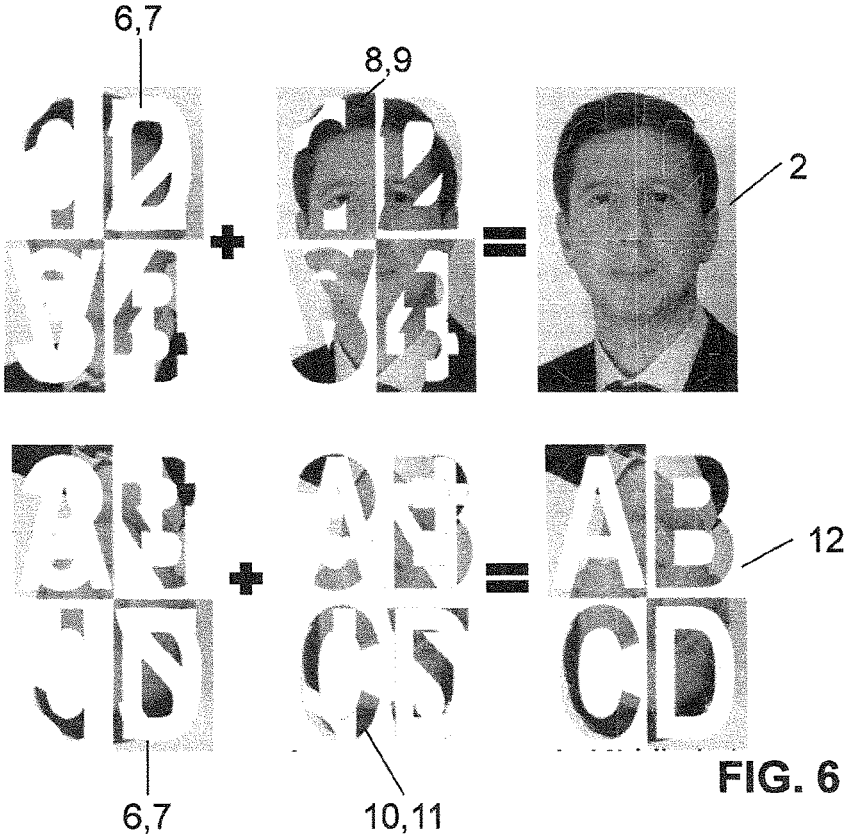
FIG. 6 shows a further embodiment of the security element according to the invention in accordance with the present invention in the separated and overlaid state.
Figure 7:
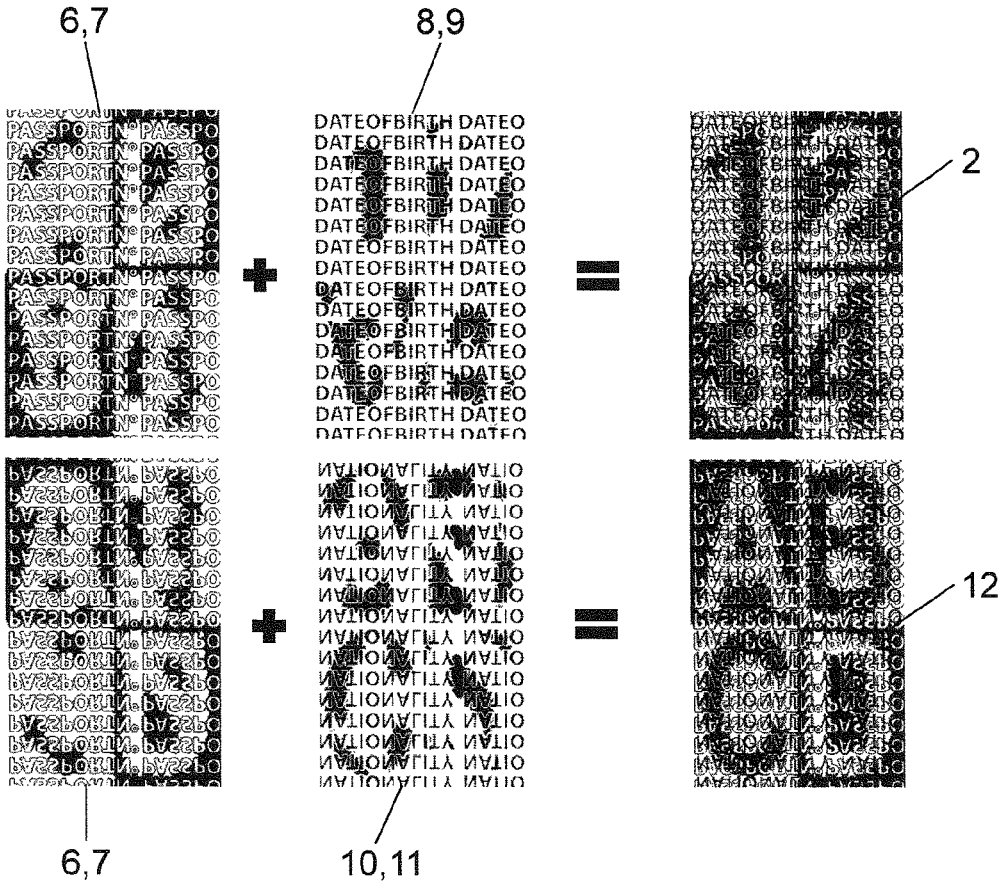
FIG. 7 shows a further embodiment of the security element according to the invention in accordance with the present invention in the separated and overlaid state.

The authenticity information item 2, 12 can also have a different form, as is shown in FIGS. 5 to 7. FIG. 5 shows the combination of an image of a person with alphanumeric characters. In FIG. 6, the authenticity information item 2, 12 has the form of a portrait. In FIG. 7, the authenticity information item 2, 12 has the shape of different alphanumeric characters.

The authenticity information item 2, 12 can thus, as illustrated in the figures, have various configurations. However, with particular preference, the authenticity information item 2, 12 is individualized or personalized. An individualized information item is understood to mean an information item which is assigned to a document. A personalized information item is understood to mean an information item which allows a determination to be made with respect to the owner of the document. The serial number of a document is one example of an individualized authenticity information item 2, 12. A portrait, a date of birth or the place of birth are examples of a personalized authenticity information item.

FIG. 5 shows that the first partial information item 7 represents a first part of the at least one image or of the at least one alphanumeric character. The second partial information item 9, which is shown to the right of the first partial information item 7, represents a second part of the image or of the alphanumeric character. On the far right, the overlay of the first partial information item 7 and the second partial information item 9 is represented. The overlay in the present case is a type of sum formation between the two partial information items 7 and 9. The first partial information item here supplements the second partial information item to form the first authenticity information item 2.

In the further image set in FIG. 5, the combination of the first partial information item 7 with the third partial information item 11 is shown. The first partial information item 7 is here shown on the far left, followed by the third partial information item 11. On the far right, the overlay of the first partial information item 7 with the third partial information item 11 is shown. This overlay forms the further authenticity information item 12. It can be easily seen in FIG. 5 that the first partial information item 7 is identical in both authenticity information items 2, 12. The second and the third partial information items 9, 11 differ from one another, which then results in a different authenticity information item 2, 12.

FIGS. 6 and 7 show configurations which are very similar to FIG. 5, which is why reference is made to the above description.

All embodiments in the figures show that the partial information item 7, 9, 11 is provided to be optically variable from immediately adjacent regions, which are also regions of the partial element 6, 8, 10. The partial element 6, 8, 10 thus comprises an optically perceivable partial information item 7, 9, 11. The partial information item 7, 9, 11 is in particular provided in the form of an opaque and/or semi-opaque (translucent) region in the partial elements 6, 8, 10. The opaque or semi-opaque region carries the reference sign 21. An opaque region is understood to mean a region which is configured such that it is substantially not see-through. A semi-opaque or translucent region is understood to mean a region which is somewhat translucent, but not completely transparent. Such a region is optically perceivable.

At least one of the partial elements, in the present case partial element 7, furthermore comprises at least one transparent or translucent region 13, through which the partial information item 9, 11 of the other partial elements 8, 10 becomes visible in the case of an overlay, and an opaque or semi-opaque region 21. Due to the overlay, the authenticity information item 2, 12 thus becomes representable or completable. A transparent region is understood to mean a region which is substantially completely transparent or see-through. A translucent region is understood to be a region which is not completely transparent and is not opaque, with the result that an information item located behind the translucent region can be optically captured through said region.

The transparent or translucent region 13 is preferably provided in the form of a window 14. The window 14 is shown in FIG. 1. The window 14 is here part of the carrier part 3 and is preferably fixedly integrated in the carrier part 3. Opaque and/or semi-opaque regions representing the partial information item 7 are present in the region of the window. The partial information item 7 in FIG. 1 is represented in the window 14 in the form of a black area 7.

The regions around the black region 7 are here transparent or translucent, and the observer can see through these regions in the viewing direction V and in the viewing direction H and detect a further information item located therebelow. If the carrier part 3 is folded down in the direction of the second carrier part 4 from the starting position into the check position, the window 14 comes to rest on the second partial information item 9. The user can then identify the second partial information item through the window 14 in the viewing direction H. The second partial information item 9 and the first partial information item 7 here represent said authenticity information item 2, wherein in the present case, the first partial information item 7 completes the second partial information item 9. Equally, folding the first carrier part 3 down to the third carrier part 5 from the starting position into the check position can represent the authenticity information item 12. The viewer can see through the window 14 in the viewing direction V and thereby detects the third partial information item 11. The first partial information item 7 and the third partial information item 11 thereby complete the further authenticity information item 12.

With respect to the viewing directions V and H, it should also be noted that in the viewing direction V, the first partial information item 7 is detectable as positive, and in the viewing direction H the first partial information item is detectable as negative.

The partial information items 7, 9, 11 are provided on the corresponding partial elements 6, 8, 10 by way of a suitable processing means. The processing means can be a printer. The printer is used to print regions or partial regions of said partial information item 7, 9, 11. The processing means can alternatively, or in combination with the printer, be a laser which provides said regions or partial regions by way of a laser-activatable additive which is variable in terms of color through processing being carried out with the laser. In a further embodiment, the processing means can be a laser, wherein said regions or partial regions are provided by way of locally destroying a metal film or plastics pigments by way of the laser. This is metal or plastics ablation. The regions or partial regions which represent the partial information item 7, 9, 11 can also be provided by a combination of the processing means.

With respect to all embodiments it should be noted that the authenticity information item 2, 12 can be distributed randomly over the partial elements 6, 8, 10. That means the partial information item 7, 9, 11 on the partial elements 6, 8, 10 has a random form. The randomness has the advantage that the security against forgeries of such elements is further increased and that a forger cannot pre-produce such security elements. For example, a random generator can be used for the random distribution.

Alternatively, the authenticity information item 2, 12 on the partial elements 6, 8, 10 can also be distributed according to a predetermined scheme, for example according to a predetermined algorithm. That means that the partial information items 7, 9, 11 are distributed and produced according to this predetermined scheme. Such an embodiment has the advantage that the authenticity of the partial information item as such can be checked at a later date.

The partial elements 6, 8, 10 are preferably defined in terms of area. That means that the partial elements 6, 8, 10 have a specific and predefined area. This is shown for example in FIG. 1, where the partial elements 6, 8, 10 are delimited by way of a peripheral line 15. The peripheral line 15 does not absolutely necessarily have to be present, but substantially serves as a border for the determination of the expansion of the partial element 6, 8, 10 on a corresponding carrier part 3, 4, 5. The peripheral line can also be printed. The area of all partial elements 6, 8, 10 is preferably identical. Furthermore, the partial elements 6, 8, 10 are positioned in a document, as is shown for example in FIG. 1, in each case preferably in the same location, with the result that the overlaying in the check position is achievable as easily as possible.

FIG. 1 shows, as explained earlier, an identification document 16. The identification document 16 is preferably a passport. The identification document 16 comprises at least one security element according to the above description and at least one first page 17 corresponding to the first carrier part 3 and a second page 18 corresponding to the second carrier part 4. The first partial element 6 is here fixedly connected to the first page 17 or is an integral part of the first page 17. The second partial element 7 is fixedly connected to the second page 18 or is an integral part of the second page 18. By overlaying the pages 17, 18 in the check position, the first partial information item 7 is located on top of the second partial information item 9, and thus said authenticity information item 2 is represented. The identification document 16 furthermore comprises a third page 19 corresponding to the third carrier part 5. The third page 19 is here arranged opposite the second page 18. That means that the first page 17 can be moved both toward the second page 18 and toward the third page 19. The third partial element 10 is fixedly assigned to the third page 19 and is fixedly connected thereto or is an integral part thereof. In the case of an overlay in the check position of the two pages 17, 19, the first partial information item 7 overlays the third partial information item 11, and said authenticity information item 12 is represented or completed in the overlaid region.

The first page 17 and the second page 18 and, if present, the third page 19 are detachably connected to one another, such as for example via a seam. It is thus theoretically possible for one of the pages to be replaced by a forger. In this case, such a replacement can be easily determined by checking the authenticity information items, and the forgery can thus be easily uncovered.

The first page 17 is preferably a data page of a passport. The data page is typically made of plastics, in particular polycarbonate. A multiplicity of personalized information items are stored on the data page in an optically perceivable and/or electronically readable manner. The second page is preferably a visa page and consists in particular of a security paper. However, individualized and/or personalized information items can also be present on the visa page. The third page can likewise be a visa page or the page of a cover.

FIGS. 8*a* to 8*d* show further examples of partial information items 7, 9, 11, which are then combined to form authenticity information items 2, 12. In principle, reference may be made to the above description, wherein an additional aspect will be explained below with reference to said figures.

Figure 8A:
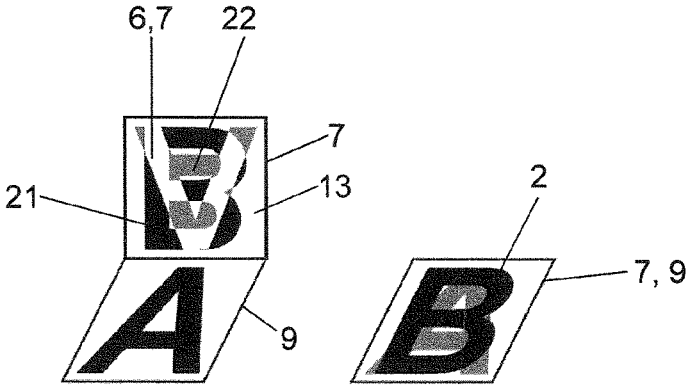
FIGS. 8*a*-8*d* show further embodiments of the security element according to the invention in accordance with the present invention in the separated and overlaid state.

In FIG. 8*a*, the first partial information item 7 has the form of different letters, and the second partial information item 9 has the form of the letter A. The first partial information item 7 comprises transparent regions 13 and opaque regions 21. The opaque regions 21 are additionally provided with further information items within the opaque regions. Said further information items are part of the respective partial information item 7 and carry the reference numeral 22. The opaque regions 21 of the first partial information item 7 in the check position cover parts of the second or third partial information item 9, 11 and complete them with the further information item 22 within the opaque regions 21. This is shown on the far right in the picture in FIG. 8*a*.

Figure 8B:
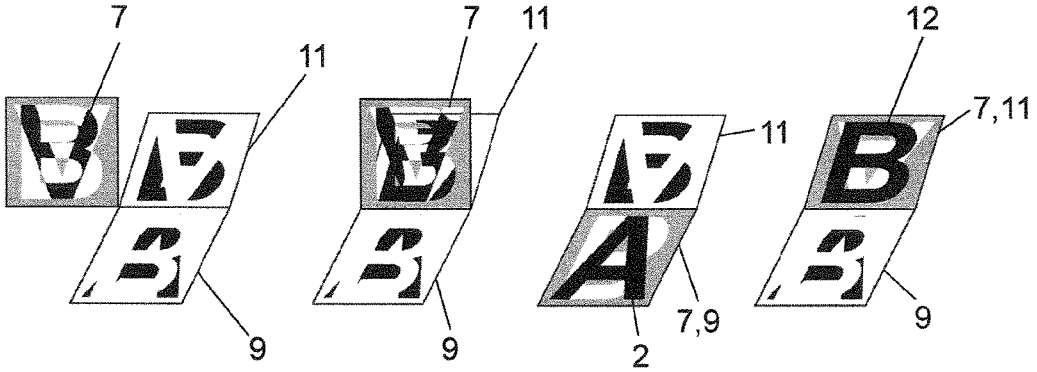
Figure 8C:
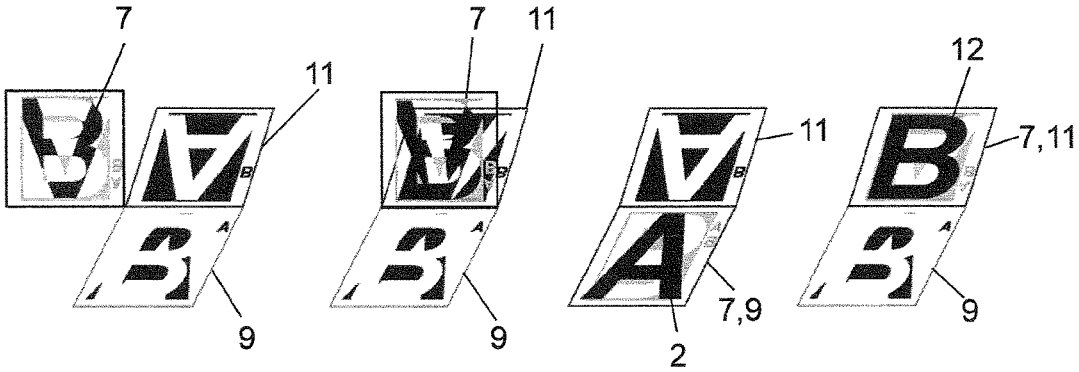

To provide a better understanding, FIGS. 8*b* and 8*c* on the far left show the first partial information item 7 offset with respect to the other two partial information items 9, 11. In the second image from the left, the first partial information item 7 is in the starting position. The first partial information item 7 comprises transparent regions 13 and opaque regions 21. The opaque regions 21 are additionally provided with further information items within the opaque regions. Said further information items are part of the respective partial information item 7 and carry the reference numeral 22. The opaque regions 21 of the first partial information item 7 in the check position cover part of the second or third partial information item 9, 11 and complete them with the further information item 22 within the opaque regions 21. This is shown on the right in both images of FIGS. 8*b* and 8*c*.

Figure 8D:
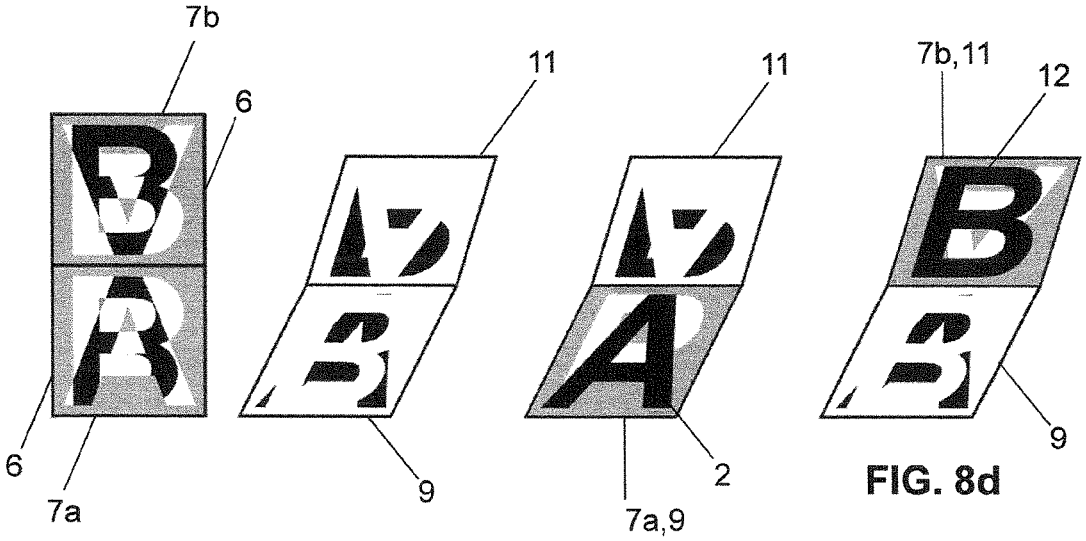

In FIG. 8*d*, in contrast to the examples in FIGS. 8*a* to *c*, the further information item 22 is applied in a manner such that the partial information item takes a different form, depending on the viewing direction toward the partial element 6. In the image of FIG. 8*d*, on the far right, the partial information item 7*a* is produced for the one viewing direction, and the partial information item 7*b* for the other viewing direction. As illustrated in the two right-hand images of FIG. 8*d*, depending on the viewing or combination direction, the result of the second partial information item 9 with the partial information item 7*a* is the authenticity information item 2, and the result of the third partial information item 11 with the partial information item 7*b* is the authenticity information item 12.

Figure 9:
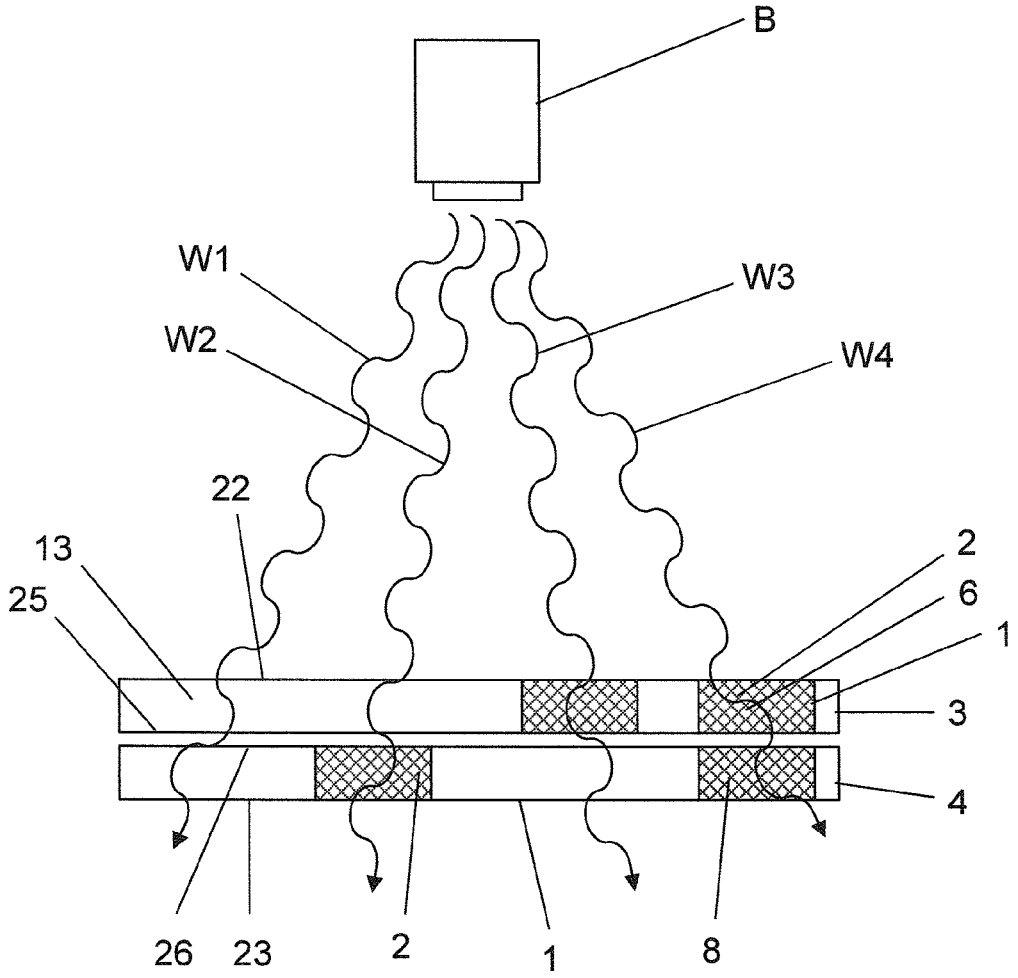
FIG. 9 shows a schematic view of a processing means in particular for producing a security element in accordance with the preceding figures according to a preferred variant.
Figure 10:
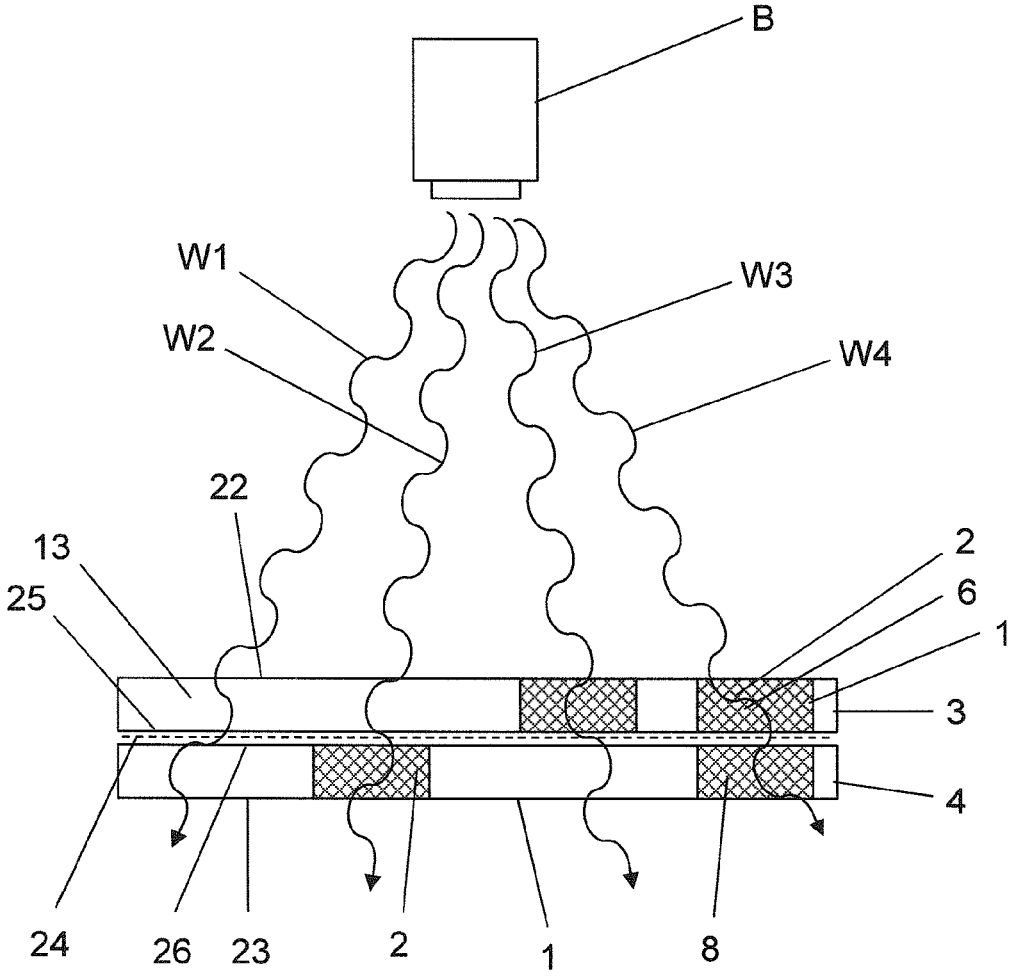
FIG. 10 shows a schematic view of a processing means in particular for producing a security element in accordance with the preceding figures according to a further preferred variant.

FIGS. 9 and 10 show a method according to the invention for producing the authenticity information item 2 of the security element 1. The security element 1 and the authenticity information item 2 can be configured in particular according to FIGS. 1 to 8*d*. Different configurations are likewise conceivable.

In FIGS. 9 and 10, details of the security element 1 are illustrated merely schematically for illustration purposes. The security element 1 comprises at least one first partial element 6 having a first partial information item 7 and a second partial element 8 having a second partial information item 9. The first partial element 6 can be assigned to a first carrier part 3, and the second partial element 8 can be assigned to a second carrier part 4. The two partial elements 6, 8 are movable from a starting position into a check position, in which the two partial elements 6, 8 overlay one another, wherein the first partial information item 7 and the second partial information item 9 represent said authenticity information item 2 in the check position. Can be assigned is here understood to mean that the partial elements 6, 8 form part of the carrier part or are connectable thereto. The first partial element 6 having the first partial information item 7 and the second partial element 8 having the second partial information item 9 are illustrated merely schematically in cross section in the figures. The hatched area here represents a perceivable change in shape after the respective partial element 6, 8 has been processed with a processing means B. The change in shape is in particular optically perceivable. The first, second and/or third partial information item or the authenticity information item are preferably optically perceivable information items. The partial information items or the authenticity information item are particularly preferably configured such that they are identifiable with the naked eye without further aids.

The method for producing the authenticity information item 2 will be explained in more detail below: In a first step of alignment, the two partial elements 6, 8 are positioned one above the other and are aligned relative to one another. The first partial element 6 is thus located in the aligned position with the second partial element 8, and vice versa. In a fixation step, which follows the alignment step, the two aligned partial elements 6, 8 are fixed relative to one another in their aligned position. A relative displacement is now no longer possible. What follows after the fixation step is a processing step using at least one processing means B. The processing means B is used to provide electromagnetic waves $W_1$, $W_2$, $W_3$, $W_4$, wherein the first partial information item 7 and the second partial information item 8 are produced with the waves $W_1$, $W_2$, $W_3$, $W_4$. Processing of the two partial elements 6, 8 takes place in the same fixation and from the same side. A change in position of the two partial elements 6, 8 which are fixed with respect to one another is not necessary.

Said electromagnetic waves are used to process one of the two partial elements, in the present case the partial element 6, directly, and to process the other one of the two partial elements, in the present case the second partial element 8, indirectly through said one partial element 6. In other words, the partial element 6, which is in this case located closer to the processing means B than the partial element 8, is processed directly by the processing means B. The partial element 8 which is located below the partial element 6 is processed through the partial element 6. Here, the electromagnetic waves penetrate the partial element 6 and then process the partial element 8. It is likewise possible for the processing parameters of the processing means B to be set such that both partial elements 6 and 8 are processed simultaneously, i.e. both partial elements are changed optically perceivably at the same time.

The common processing has the advantage that the first partial information item 7 and the second partial information item 9, which then form said authenticity information item 2 when they are overlaid, are processable in one setup, as a result of which the partial information items 7, 9 are producible such that they are aligned very exactly with respect to one another.

The two partial elements 6, 8 are exclusively and immediately processed by the processing means B. Here, a plurality of processing means B can be provided. However, what is not provided is that parts, such as for example particles, from the partial element 6 strike the partial element 8 and thus process the partial element 8. An interaction between the two partial elements 6, 8 during the production, aside from the penetration of the electromagnetic waves $W_1$, $W_2$, $W_3$, $W_4$, is not provided.

With respect to the electromagnetic waves $W_1$, $W_2$, $W_3$, $W_4$, the partial element 6, which is located closer to the processing means B, is transmissive or transparent for the electromagnetic waves $W_1$, $W_2$, $W_3$, $W_4$ at least before the processing of the partial element 6. The partial element 6, which is located closer to the processing means, is typically blackened or otherwise changed after processing, such that said transmissivity or transparency is or could be impaired. This can be seen well from the wave $W_2$, which penetrates the partial element 6 and correspondingly processes the partial element 8.

It can furthermore be seen in particular on the far right in FIG. 9 in connection with the electromagnetic wave $W_4$ that both partial elements 6, 8 are processable simultaneously, i.e. together.

During the processing with the processing means B, at least one processing parameter of said electromagnetic waves $W_1$, $W_2$, $W_3$, $W_4$ can be changed, specifically such that the first partial element 6 and/or the second partial element 8 can be processed. By changing the processing parameter, the first partial element 6 and/or the second partial element 8 can be correspondingly addressed and thus processed. This permits, for example, processing of exclusively the first partial element 6 or the second partial element 8 or of both partial elements 6, 8 together. Processing of exclusively the first partial element 6 is shown by way of the electromagnetic wave $W_1$, and that of the second partial element 8 is shown by way of the electromagnetic wave $W_2$.

The changeable operating parameter is preferably selected from the group consisting of:

- intensity or power; or
- fluence or pulse energy; or
- focal position; or
- focus diameter; or
- wavelength; or
- the combination of intensity and focal position; or
- the combination of intensity and wavelength; or
- the combination of focal position and wavelength; or
- the combination of intensity and focal position and wavelength; or
- the combination of fluence and focal position; or
- the combination of fluence and wavelength; or
- the combination of fluence and focal position and wavelength.

When changing the operating parameter intensity, the intensity of the electromagnetic waves $W_1$, $W_2$, $W_3$, $W_4$ provided by the processing means B is changed, as a result of which each of the partial elements 6, 8 can be targeted. When changing the operating parameter focal position, the focal position of the waves $W_1$, $W_2$, $W_3$, $W_4$ provided by the processing means B is changed, as a result of which each of the partial elements 6, 8 can be targeted. Finally, in the operating parameter wavelength, the wavelength of the waves $W_1$, $W_2$, $W_3$, $W_4$ provided by the processing means is changed, as a result of which again each of the partial elements 6, 8 can be targeted. Preferred are wavelengths generated by solid-state lasers which can extend from the UV range into the infrared range. Particularly preferred is at least for one processing means a wavelength from the near infrared range of approximately 1000 nm to approximately 1200 nm.

Depending on the thickness of the individual partial elements 6, 8, said operating parameters can also be adapted such that they do not process the entire thickness of the partial element 6, 8, but merely a partial region of the total thickness, as a result of which a three-dimensional effect can be attained. That means that the processing parameter is preferably changeable such that each position between the upper side 22 of the first partial element 6 and the bottom side 23 of the second partial element 8 can be targeted. Preferably, the upper side 22 and the bottom side 23 can also correspondingly be targeted, and are thus included in the region between upper side 22 and bottom side 23. Depending on the configuration of the partial elements 6, 8, positions within the partial elements or on the surface of the partial elements 6, 8 can thus be processed.

The surfaces of the partial elements 6, 8 carry the reference signs 22, 23, 25 and 26. It is possible to process said surfaces 22, 23, 25 and 26 with the processing means B.

The electromagnetic waves of the processing means B are moved by optical devices, such as mirrors, during the processing of the respective partial elements 6, 8 relative to the surfaces 22, 23, 25 and 16 over the partial element 6, 8. That means the electromagnetic waves are guided over the respective surfaces. That means that the partial elements 6, are traversed by the electromagnetic waves of the processing means B in the region in which the partial information item 7, 9 is to be produced. In the case of a fixed wave propagation direction, it is also possible to move the position of the processing means B for processing the locally expanded region on the partial elements 6, 8 correspondingly relative thereto. Alternatively, in the case of fixed processing means B, it is also possible to move the partial elements 6, 8 relative thereto.

The expansion region of the partial information item can here be traversed in various ways by the electromagnetic waves of the processing means B. In a first preferred variant, the electromagnetic waves of the processing means B are traversed systematically over the expansion region of the partial information item 7, 9 parallel to the surface of the respective partial element 6, 8, wherein at least one of said processing parameters is changed during the traversing. As a result, the partial information item on the corresponding partial element 6, 8 can be produced in one pass.

In an alternative, but likewise preferred variant, the expansion region of the partial information item 7, 9 is systematically traversed by the electromagnetic waves of the processing means B in at least two passes. At least one of said processing parameters is then changed before each of the passes. That means that the at least one processing parameter is set at the beginning of each pass, and is then changed correspondingly before the beginning of the next pass. However, it is also conceivable that the processing parameter is changed during the traversing.

In a first preferred embodiment of the present invention, exactly one processing means B is present, wherein the processing parameter thereof can be set or changed corresponding to the above description.

In a second preferred embodiment, at least one first processing means B and at least one second processing means are present, which provide said electromagnetic waves. However, it is also possible for more than two processing means to be present. The processing parameters of the first processing means B are preferably different from the processing parameters of the second processing means.

In the plurality of processing means, the expansion region of the partial information item can be systematically traversed by the processing means in one pass parallel to the surface 22, 23 of the respective partial element 6, 8, wherein each of the processing means B is activated and/or deactivated during the traversing. It is also possible here for at least one processing parameter to be correspondingly changed.

Alternatively, the expansion region of the partial information item can be traversed in several passes by the processing means B parallel to the surface of the respective partial element 6, 8. Per pass, one of the plurality of processing means B is active, and the other of the processing means B is deactivated during said pass. The processing parameter can be fixed or varied per pass.

During the processing, the two partial elements 6, 8 are in direct surface contact with one another, as is shown in FIG. 9. In surface contact means that no other element is located between the two partial elements 6, 8.

Alternatively, as shown in FIG. 10, a separating film 24 is inserted between the two partial elements 6, 8 before or during the alignment step. The two surfaces 25, 26 are then in contact with said separating film 24.

The separating film 24 can be provided with an adhesive layer on the side facing the first partial element 6 and/or on the side facing the second partial element 8. Particles which are removed during the processing of the respective partial element 6, 8 can adhere to the adhesive layer.

Alternatively or additionally, the separating film 24 can also serve as a carrier for an ink, which is detached from the separating film 24 by way of processing with the processing means B and adheres to the first and/or the second partial element.

The response behavior of the first partial element 6 with respect to the electromagnetic waves $W_1$, $W_2$, $W_3$, $W_4$ of the processing means B is different from the response behavior of the second partial element 8. With respect to the processing parameters that means that the response behavior of the first partial element 6 with respect to a defined set of processing parameters is different from the response behavior of the second partial element 8 with respect to the same set of processing parameters. Due to this different response behavior, the first partial element 6 and the second partial element 8 can be processed with the same processing parameters with different results. For example, the first partial element 6 is changed in terms of its color, and the second partial element 8 is not processed. It is likewise possible for a specific combination of processing parameters to process both partial elements 6, 8 at the same time.

The first partial element 6 is preferably made of a plastics or constructed in multiple layers from different plastics. Suitable plastics are in particular polycarbonate (PC), polyvinyl chloride (PVC), glycol-modified polyethylene terephthalate (PET-G) or polyethylene terephthalate (PET).

The second partial element 8 is preferably a paper substrate, in particular a security paper, wherein both the plastics and the paper substrate are optically perceivably changeable by the processing means B. In one preferred embodiment, an ink layer and/or a stamping foil layer are applied to the paper substrate. During processing with the processing means, the paper substrate with the ink layer or the paper substrate with the stamping foil layer is thereby correspondingly optically perceivably changed. For example, a color change is generated or the layer is removed by way of laser processing. The processing means B is preferably a laser, which provides said electromagnetic waves $W_1$, $W_2$, $W_3$, $W_4$.

LIST OF REFERENCE SIGNS

1 security element
2 authenticity information item
3 first carrier part
4 second carrier part
5 third carrier part
6 first partial element
7 first partial information item
8 second partial element
9 second partial information item
10 third partial element
11 third partial information item
12 authenticity information item
13 transparent or translucent region
14 window
15 peripheral line
16 identification document
17 first page
18 second page
19 third page
20 joint
21 opaque/semi-opaque region
22 upper side
23 bottom side
24 separating film
B processing means

The invention claimed is:

1. A method for producing an authenticity information item of a security element, which authenticity information item serves for checking a correct combination of at least two, or exactly two, carrier parts, wherein the security element comprises at least one first partial element having a first partial information item and a second partial element having a second partial information item, wherein the first partial element is assignable to a first carrier part and the second partial element is assignable to a second carrier part, and wherein the two partial elements are movable from a starting position into a check position, in which the two partial elements overlay one another, wherein the first partial information item and the second partial information item in the check position represent said authenticity information item, the method comprising the steps of:

positioning the two partial elements one above the other and aligning the two partial elements relative to one another in an alignment step, fixing the two partial elements in their aligned position relative to one another in a fixation step, and providing electromagnetic waves with at least one processing means in a processing step, with which waves, the first partial information item and the second partial information item are produced, wherein one of the two partial elements is processed with the electromagnetic waves directly, and the other of the two partial elements is processed through said one partial element.

2. The method as claimed in claim 1, wherein both partial elements are processed exclusively and immediately by the processing means.

3. The method as claimed in claim 1, wherein the partial element which is located closer to the processing means is transmissive or transparent for the electromagnetic waves at least before the processing.

4. The method as claimed in claim 1, wherein the first partial information item differs from the second partial information item.

5. The method as claimed in claim 1, wherein at least one processing parameter of said electromagnetic waves is changed such that selectively either the first partial element or the second partial element is processed or wherein at least one processing parameter of said electromagnetic waves is changed such that the first partial element and/or the second partial element can be processed.

6. The method as claimed in claim 5, wherein the at least one processing parameter is an intensity, wherein an intensity of the electromagnetic waves provided by the processing means is changed, as a result of which each of the partial elements can be targeted, and/or wherein the at least one processing parameter is a focal position, wherein a focal position of the electromagnetic waves provided by the processing means is changed, as a result of which each of the partial elements can be targeted, and/or wherein the at least one processing parameter is a wavelength, wherein a wavelength of the electromagnetic waves provided by the processing means is changed, as a result of which each of the partial elements can be targeted, and/or wherein the at least one processing parameter is a pulse energy and/or laser power, wherein a pulse energy and/or a laser power of the electromagnetic waves provided by the processing means is changed, as a result of which each of the partial elements can be targeted.

7. The method as claimed in claim 5, wherein the at least one processing parameter is changed such that each position between an upper side of the first partial element and a bottom side of the second partial element is processable.

8. The method as claimed in claim 1, wherein the production of said first and second partial information items takes place in one fixation, wherein in this fixation, both the first partial element and the second partial element are processed.

9. The method as claimed in claim 5, wherein an expansion region of the partial information items is systematically traversed by the processing means parallel to a surface of the respective partial element, wherein said at least one processing parameter is changed during the traversing;

or wherein the expansion region of the partial information items is systematically traversed by the processing means in at least two passes, wherein said at least one processing parameter is changed for each of the passes.

10. The method as claimed in claim 1, wherein exactly one processing means is present, a processing parameter of which can be set.

11. The method as claimed in claim 1, wherein at least one first processing means and at least one second processing means are present, which provide electromagnetic waves with different processing parameters.

12. The method as claimed in claim 11, wherein an expansion region of the first and second partial information item is systematically traversed by the first and second processing means in one pass parallel to a surface of the respective partial element, wherein the respective processing parameters are changed, or wherein the expansion region of the first and second partial information item is systematically traversed by the first and second processing means in at least two passes parallel to the surface of the respective partial element, wherein one of the first and second processing means is active during the one pass with fixed or varying processing parameters, and wherein the other one of the first and second processing means is deactivated during said pass.

13. The method as claimed in claim 1, wherein the two partial elements are in direct surface contact with one another during the processing step.

14. The method as claimed in claim 1, wherein a separating film is inserted between the two partial elements before or during the alignment step.

15. The method as claimed in claim 14, wherein the separating film is provided with an adhesive layer on a side facing the first partial element and/or on a side facing the second partial element, and/or wherein the separating film serves as a carrier for an ink, which is detached from the separating film through processing with the processing means and adheres to the first partial element and/or the second partial element.

16. The method as claimed in claim 1, wherein no interaction, in particular no transfer of particles, takes place between the first partial element and the second partial element during the processing with the processing means.

17. A security element produced according to the method as claimed in claim 1, wherein a response behavior of the first partial element with respect to a defined setting of processing parameters differs from a response behavior of the second partial element with respect to the same setting of processing parameters.

18. The security element as claimed in claim 17, wherein the first partial element is made of plastics and the second partial element is a paper substrate, wherein both the plastics and the paper substrate are variable in an optically perceivable manner.

19. The security element as claimed in claim 18, wherein an ink layer and/or stamping foil layer is applied to the paper substrate, which is changed by processing with the processing means in an optically perceivable manner.

20. The security element as claimed in claim 17, wherein processing with the processing means brings about a color change and/or a material removal on the first partial element and/or on the second partial element.

* * * * *